US005682915A

United States Patent [19]

Martin

[11] Patent Number: 5,682,915

[45] Date of Patent: Nov. 4, 1997

[54] PORTABLE SUN SCREEN

[76] Inventor: James E. Martin, 7655 E. Mariposa Dr., Scottsdale, Ariz. 85251

[21] Appl. No.: 665,906

[22] Filed: Jun. 19, 1996

[51] Int. Cl.[6] ..... A45B 11/00

[52] U.S. Cl. ..... 135/20.1; 135/33.2; 248/167

[58] Field of Search ..... 135/19, 19.5, 33.2, 135/20.1, 904; 248/166, 167, 439

[56] References Cited

U.S. PATENT DOCUMENTS

| | | | |
|---|---|---|---|
| 1,946,137 | 2/1934 | Frost | 155/1 |
| 2,180,125 | 11/1939 | Smith | 248/167 X |
| 2,213,058 | 8/1940 | Sweet et al. | 135/33.2 X |
| 3,284,965 | 11/1966 | Michenfelder | 52/2 |
| 4,285,489 | 8/1981 | Blanchard | 248/166 X |
| 4,336,916 | 6/1982 | Blanchard | 248/166 X |
| 4,407,319 | 10/1983 | Shultz et al. | 135/904 X |
| 5,059,463 | 10/1991 | Peters | 428/65 |
| 5,379,786 | 1/1995 | Lynam | 135/87 |
| 5,421,354 | 6/1995 | Bolton | 135/33.2 X |
| 5,551,465 | 9/1996 | Steiner | 135/33.2 X |

FOREIGN PATENT DOCUMENTS

| | | | |
|---|---|---|---|
| 0948421 | 8/1949 | France | 135/20.1 |
| 1326938 | 4/1963 | France | 135/904 |

*Primary Examiner*—Lanna Mai
*Attorney, Agent, or Firm*—Joseph N. Breaux

[57] ABSTRACT

A sun screening device includes a hollow vertical support column including a retractable tripod leg assembly retractable within a first end of the vertical support column; an angularly positionable locking support head assembly in connection with a second end of the vertical support column; and an accordion fold sun screening assembly in connection with the angularly positionable support head assembly. The sun screening assembly is fully deployable into a substantially circular sun screen and can be collapsed for easy transportation and storage of the sun screening device.

13 Claims, 2 Drawing Sheets

PORTABLE SUN SCREEN

TECHNICAL FIELD

The present invention relates to portable devices used to provide shade and more particularly to a sun screening device having a collapsible, accordion fold sun screen assembly provided on an angularly positionable locking head assembly.

BACKGROUND ART

It is often desirable to provide sun screening at remote locations where permanent sun screening is not provided. This sun screening is generally accomplished by erecting a fabric or plastic sheeting canopy or positioning a collapsible fabric or plastic sheeting umbrella above the area to be screened. Although canopies and collapsible umbrellas provide adequate sun screening capabilities, the fabric or plastic screening used to construct the sun screening portions thereof may become damaged by mildew during storage or damaged by tearing during use. It would be beneficial, therefore, to have a portable sun screen device that did not utilize a fabric sun screening member within the sun screening assembly. It would be a further benefit to have a sun screening device that had a collapsible sun screening assembly that could be conveniently transported and stored.

GENERAL SUMMARY DISCUSSION OF INVENTION

It is thus an object of the invention to provide a portable sun screen that utilizes a collapsible, accordion fold sun screening assembly.

It is a further object of the invention to provide a portable sun screen that includes a collapsible sun screening assembly that is positionable at a variety of user selected angles.

Accordingly, a sun screening device is provided. The sun screening device comprises a hollow vertical support column including a retractable tripod leg assembly retractable within a first end of the vertical support column; an angularly positionable locking support head assembly in connection with a second end of the vertical support column; and an accordion fold sun screening assembly in connection with the angularly positionable support head assembly. The sun screening assembly is fully deployable into a substantially circular sun screen and can be collapsed for easy transportation and storage of the sun screening device. In a preferred embodiment, the vertical column is provided with a carrying handle. The carrying handle is preferably provided on the vertical support column at a point above the center of mass of the sun screening device. It is also desirable to provide the sun screen device with a height adjustment mechanism for the angularly positionable locking support head assembly to allow the user to select a desirable height for the sun screening assembly.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
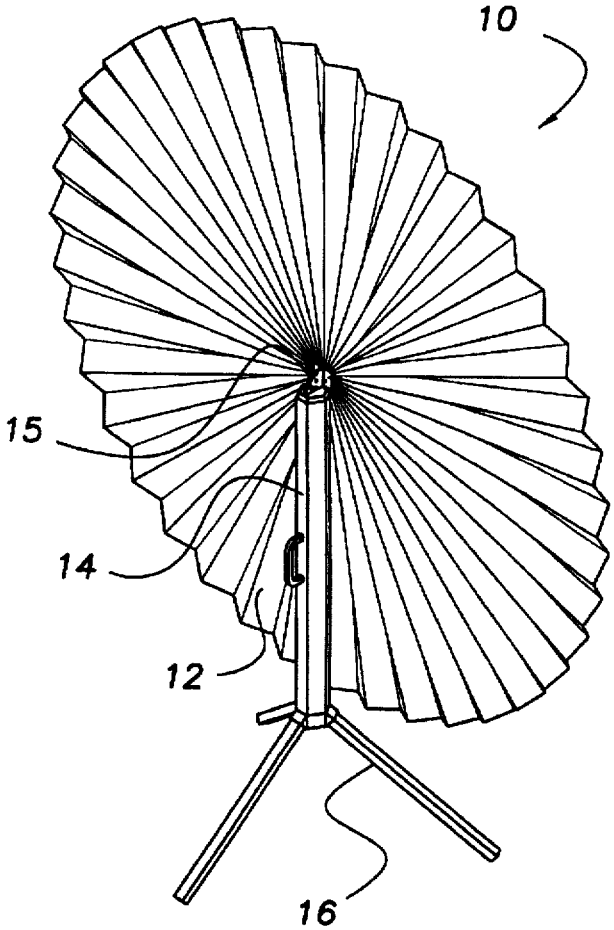
FIG. 1 is a perspective view of the sun screening device of the present invention showing the accordion fold sun screening assembly fanned out, the vertical column, and the tripod leg assembly fully deployed.
Figure 2:
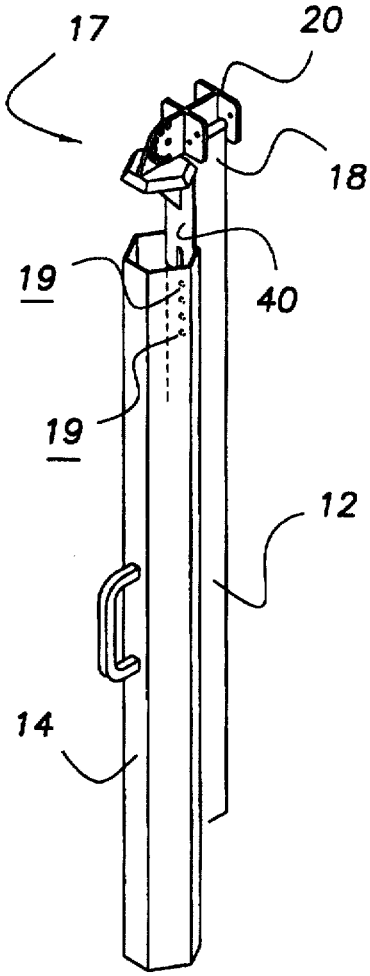
FIG. 2 is a side view of the sun screening device of the present invention showing the accordion fold sun screening assembly collapsed for transportation or storage, the vertical column, the tripod leg assembly fully retracted within the vertical column, and the angularly positionable locking head assembly raised above the vertical column by the adjustable height mechanism.

FIG. 1 shows an exemplary embodiment of the sun screening device of the present invention generally referenced by the numeral 10. Sun screening device 10 includes an accordion fold sun screening assembly 12, a hollow vertical column 14, an angularly adjustable locking head assembly 15 and a retractable tripod leg assembly 16. Sun screening assembly 12 is a section of plastic sheeting that is crease folded into an accordion fold fan. The ends of the accordion fold fan are securable together in a manner to form a substantially circular sun screen. The ends of the accordion fold fan are secured together with sections of hook and pile fasteners, however, any conventional clipping or fastening method or device may be used to fasten the ends together. With reference to FIG. 2, sun screen assembly 12 is collapsible in a substantially parallel orientation with hollow vertical column 14. A first end 18 of screening assembly 12 is pivotally connected to a sun screening assembly connection portion 20 of angularly positionable locking head assembly 15.

Also shown in FIG. 2 is the adjustable height mechanism, generally indicated by the numeral 17. Adjustable height mechanism 17 includes a plurality of height adjustment holes 19 provided through the sidewall of hollow vertical column 14 and a spring loaded pin 21 shown in FIGS. 4 and 5) provided on an outer surface of a column insert member 40 that is adapted to fit within an insert receiving channel 42 (shown in FIG. 6) of hollow vertical column 40. Spring loaded pin 21 is selectively positioned through any of height adjustments holes 19 such that the vertical height of angularly adjustable locking head assembly 15 can be adjusted to a desirable height by the user.

Figure 3:
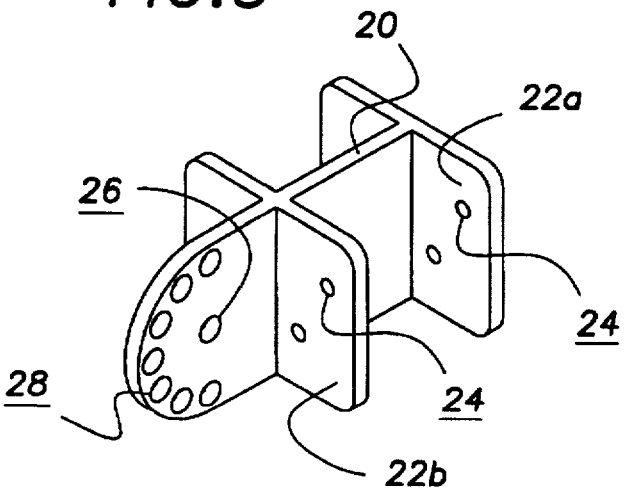
FIG. 3 is a perspective view of the sun screening assembly connection portion of the angularly positionable locking head assembly.

FIG. 3 shows sun screening assembly connection portion 20 in isolation. Connection portion 20 is constructed from metal and includes spaced plates **22*a*, 22*b* each having a pair of pivot pin apertures 24 between which first end 18 of screening assembly 12 is pivotally connected. An angular adjustment plate 26 extends perpendicularly from spaced plate 22*b* and is provided with a central angular adjustment aperture 26 and a plurality of locking apertures 28** along a section of the perimeter thereof.

Figure 4:
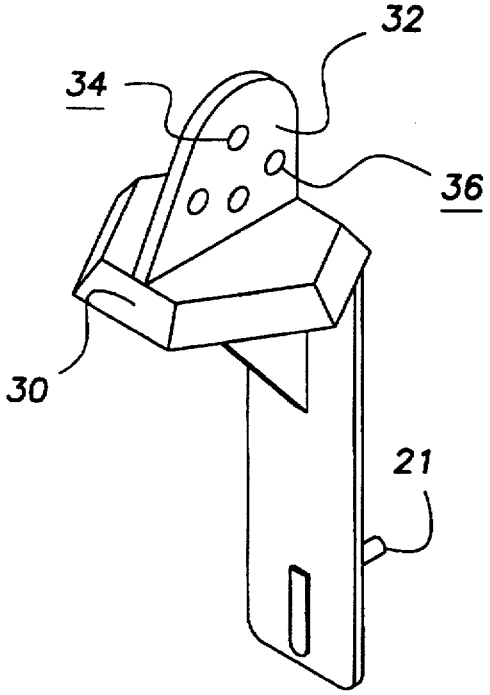
FIG. 4 is a perspective view of the vertical column connection portion of the locking head assembly.
Figure 5:
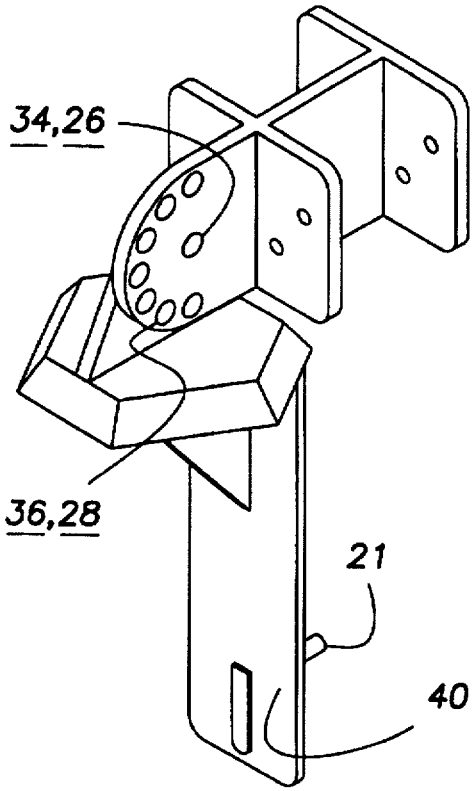
FIG. 5 is a perspective view of locking head assembly in isolation.
Figure 6:
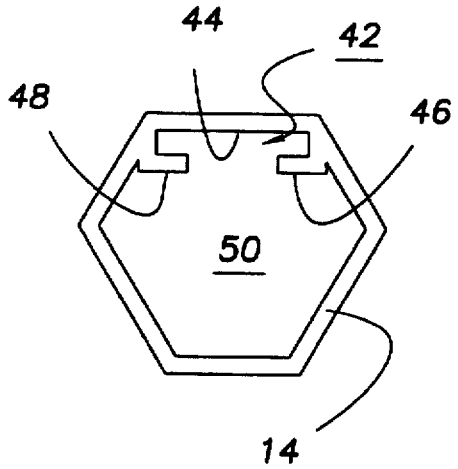
FIG. 6 is a top plan view of the first and second ends of the vertical column showing the locking head insert receiving channel and the tripod leg assembly insert receiving channel.

FIG. 4 shows a vertical column connection portion 30 in isolation. Vertical column connecting portion 30 is constructed from metal and includes a second angular adjustment plate 32 that is provided with a central pivot aperture 34 and a plurality of locking apertures 36. With reference to FIG. 5, locking apertures 36 are positioned with respect to central pivot aperture 34 in a manner such that when central pivot aperture 34 and central angular adjustment aperture 26 are aligned and connected with a pivot pin, locking apertures 36 are alignable with locking apertures 28. Once locking apertures 36 and locking apertures 26 are aligned the angular position of sun screening assembly connection portion 20 can be locked with respect to vertical column connection portion 30 by inserting a pin through the aligned locking apertures 36,28. Vertical column connecting portion 30 also includes a column insert member 40 that is adapted to fit within an insert receiving channel 42 (shown in FIG. 6) formed along the interior side surface 44 of hollow vertical column 14. With further reference to FIG. 6, insert receiving channel 42 is formed by two right angled members 46,48 that extend into the passageway 50 formed within hollow vertical column 14. The first and second ends of hollow vertical column 14 are identical. The second insert receiving channel is provided for receiving a substantially planar tripod insert member 52 (FIG. 7).

Figure 7:
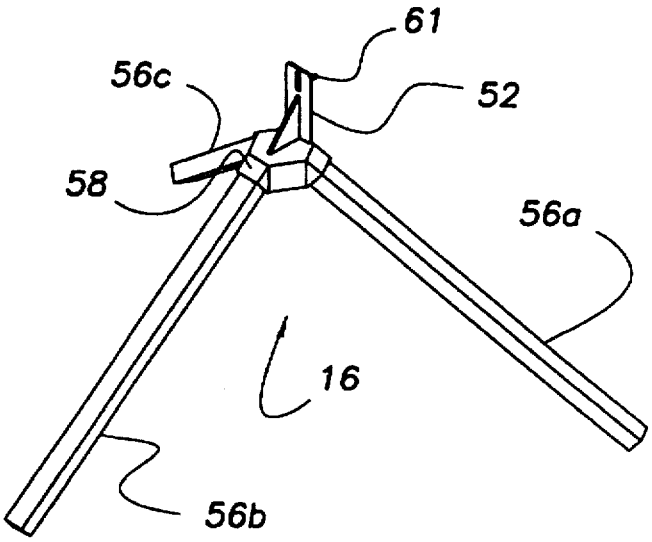
FIG. 7 is a perspective view of the tripod assembly showing the tripod leg assembly insert positioned above the collapsing legs.

With further reference to FIG. 7, tripod leg assembly 16 Includes three collapsible legs **56*a*,56*b*,56*c* that are pivotally mounted to a central pivot member 58. Tripod insert member 52 extends from central pivot member 58 in a manner such that when legs 56*a*–*c* are collapsed, legs 56*a*–*c* and central pivot member 58 are insertable completely into passageway 50 for storage. A first hole is provided through the sidewall of hollow vertical column 14 and a spring loaded pin 61 is provided on an outer surface of tripod insert member 52 in a manner such that legs 56*a*–*c* and central pivot member 58 are lockable in a first position completely within passageway 50 by positioning the spring loaded pin through the first hole. A second hole is provided through the sidewall of hollow vertical member 14 at a second location such that the central pivot member 58** may be locked in a fully extended position by insertion of the spring loaded pin through the second hole.

It can be seen from the preceding description that a portable sun screen has been provided that utilizes rigid screening elements to form a sun screening assembly, and that includes a collapsible sun screening assembly.

It is noted that the embodiment of the portable sun screen described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A portable sun screen device comprising:

a hollow vertical support column including a retractable tripod leg assembly retractable within a first end of the vertical support column;

an angularly positionable locking support head assembly in connection with a second end of the vertical support column; and an accordion fold sun screening assembly in connection with the angularly positionable support head assembly, said sun screening assembly being fully deployable into a substantially circular sun screen;

said locking head assembly including:

a sun screening assembly connection portion having a pair of spaced apart plates, each having a pivot pin aperture formed therethrough in concentric alignment, and an angular adjustment plate that extends perpendicularly with respect to said spaced apart plates that is provided with a central angular adjustment aperture and a plurality of first locking apertures along a section of the perimeter thereof; and a vertical column connection portion including a second angular adjustment plate that is provided with a central pivot aperture and a plurality of second locking apertures, said plurality of second locking apertures being positioned with respect to said central pivot aperture in a manner such that when said central pivot aperture and said central angular adjustment aperture are aligned and connected with a pivot pin, said second locking apertures are alignable with said first locking apertures.

2. The portable sun screen of claim 1, wherein:

vertical column connecting portion further includes a column insert member that is adapted to fit within an insert receiving channel formed along an interior side surface of said hollow vertical column.

3. The portable sun screen of claim 2 wherein:

said insert receiving channel is formed by two right angled members that extend into a passageway formed within said hollow vertical column.

4. The portable sun screen of claim 1, wherein:

said vertical column is provided with a carrying handle.

5. The portable sun screen of claim 4, further including:

said carrying handle is provided on said vertical support column at a point above the center of mass of said sun screening device.

6. The portable sun screen of claim 5, wherein:

said vertical column connecting portion further includes a column insert member that is adapted to fit within an insert receiving channel formed along an interior side surface of said hollow vertical column.

7. The portable sun screen of claim 6 wherein:

said insert receiving channel is formed by two right angled members that extend into a passageway formed within said hollow vertical column.

8. The portable sun screen of claim 1 wherein:

said sun screening assembly is a section of plastic sheeting that is crease folded into an accordion fold fan having ends that are securable together in a manner to form a substantially circular sun screen.

9. The portable sun screen of claim wherein:

said vertical column connecting portion further includes a column insert member that is adapted to fit within an insert receiving channel formed along an interior side surface of said hollow vertical column.

10. The portable sun screen of claim 9 wherein:

said insert receiving channel is formed by two right angled members that extend into a passageway formed within said hollow vertical column.

11. The portable sun screen of claim 1 wherein:

said sun screen assembly is collapsible in a substantially parallel orientation with respect to said hollow vertical column.

12. The portable sun screen of claim 11, wherein:

said vertical column connecting portion further includes a column insert member that is adapted to fit within an insert receiving channel formed along an interior side surface of said hollow vertical column.

13. The portable sun screen of claim 12 wherein:

said insert receiving channel is formed by two right angled members that extend into a passageway formed within said hollow vertical column.

* * * * *